US008848960B2

(12) United States Patent
Yamazaki

(10) Patent No.: US 8,848,960 B2
(45) Date of Patent: Sep. 30, 2014

(54) SPEAKER

(75) Inventor: Eiji Yamazaki, Zushi (JP)

(73) Assignee: Genus Audio Corp., Tokyo (JP)

( * ) Notice: Subject to any disclaimer, the term of this patent is extended or adjusted under 35 U.S.C. 154(b) by 825 days.

(21) Appl. No.: 12/994,099

(22) PCT Filed: Apr. 23, 2009

(86) PCT No.: PCT/JP2009/058039

§ 371 (c)(1),
(2), (4) Date: Nov. 22, 2010

(87) PCT Pub. No.: WO2009/142091

PCT Pub. Date: Nov. 26, 2009

(65) Prior Publication Data

US 2011/0085690 A1 Apr. 14, 2011

(30) Foreign Application Priority Data

May 21, 2008 (JP) ..... 2008-132716

(51) Int. Cl.
*H04R 25/00* (2006.01)
*H04R 9/06* (2006.01)
*H04R 1/28* (2006.01)

(52) U.S. Cl.
CPC ..... *H04R 9/06* (2013.01); *H04R 1/2803* (2013.01)
USPC ..... 381/353; 381/398; 381/345; 381/348; 381/346; 381/354; 381/430; 181/151; 181/146; 181/166

(58) Field of Classification Search
CPC ..... H04R 7/127; H04R 7/20; H04R 7/12; H04R 7/26; H04R 1/30; H04R 1/345; H04R 1/26; H04R 1/403; H04R 1/24; H04R 1/20; H04R 1/2803; H04R 9/06; G10K 11/002; G10K 11/004; G10K 11/16; G10K 13/00
USPC ..... 381/400–430, 345, 346, 348, 353, 354; 181/151, 155–156, 166, 198–199
See application file for complete search history.

(56) References Cited

U.S. PATENT DOCUMENTS 1,792,300 A * 2/1931 Hanna ..... 381/177
3,033,945 A * 5/1962 Villchur ..... 381/413

(Continued)

FOREIGN PATENT DOCUMENTS

JP A-58-105695 6/1983
JP B-03-059639 6/1983
JP U-58-191796 12/1983
JP A-01-320900 12/1989

(Continued)

OTHER PUBLICATIONS

International Search Report for the corresponding PCT application No. PCT/JP2009/058039.

*Primary Examiner* — Davetta W Goins
*Assistant Examiner* — Jasmine Pritchard
(74) *Attorney, Agent, or Firm* — Leason Ellis LLP.

(57) ABSTRACT

A cone speaker that outputs audio by transmitting to a truncated cone, the movements of a voice coil driven when an audio current is transmitted through a voice coil placed inside a magnetic circuit formed in a space that surrounds a pole piece. Inside a space between the back surface of a center cap attached to a central portion of the cone and the apical surface of the pole piece that faces the center cap, a first filling material composed of a flexible porous body with a low porosity fills the periphery of the space and a second filling material composed of a flexible porous body with a higher porosity than the first filling material fills the central portion thereof.

5 Claims, 4 Drawing Sheets

(56) References Cited

U.S. PATENT DOCUMENTS

| | | | | | |
|---|---|---|---|---|---|
| 3,780,232 | A * | 12/1973 | Ward | 381/403 |
| 4,395,597 | A * | 7/1983 | Suzuki et al. | 181/170 |
| 5,148,492 | A * | 9/1992 | Uzawa et al. | 381/177 |
| 5,590,211 | A * | 12/1996 | Chang | 381/398 |
| 6,785,397 | B2 * | 8/2004 | Arnstein | 381/423 |
| 7,245,739 | B2 * | 7/2007 | Suzuki | 381/430 |

FOREIGN PATENT DOCUMENTS

| | | |
|---|---|---|
| JP | U-07-042299 | 7/1995 |
| JP | A-11-098591 | 4/1999 |

* cited by examiner

SPEAKER

CROSS-REFERENCE TO RELATED PATENT APPLICATIONS

This application is a U.S. National Phase Application under U.S.C. §371 of International Patent Application No. PCT/JP2009/058039, filed Apr. 23, 2009, and claims the benefit of Japanese Patent Application No. 2008-132716, filed May 21, 2008, all of which are incorporated by reference herein. The International Application was published in Japanese on Nov. 26, 2009 as International Publication No. WO/2009/142091 under PCT Article 21(2).

BACKGROUND OF THE INVENTION

1. Field of the Invention

The present invention relates to an improvement of a speaker in which distortion of reproduced sound is eliminated by a filler.

2. Description of the Related Art

It has been general for a cone speaker, a dome speaker or a horn speaker that damping is performed with electromagnetic force occurring in a voice coil mainly to improve a transient characteristic of a speaker.

With respect to the damping based on the electromagnetic force of the voice coil as described above, when a speaker is used while connected to an amplifier through a network or an attenuator, there is a disadvantage that damping force is reduced in a fixed frequency region and thus damping runs short, so that the transient characteristic is deteriorated.

That is, a network divides audio current output from an amplifier into respective reproduction bands suitable for speakers such as a tweeter, a squawker, etc Attenuation of the audio current which is divided into the respective frequency bands of the reproduction bands is normally equal to −3 db at cross-over frequencies, however, it increases to −3 db or more at the outside of an in-use band. Therefore, large resistance (impedance) caused by the attenuation of the audio current (electrical input) is interposed between the speaker and the amplifier at the outside of the in-use band. Therefore, the damping based on the electromagnetic force does not work, and thus the damping force runs short at the outside of the in-use band, so that the transient characteristic is also degraded.

Furthermore, a method of attaching foamed rubber or the like to the back surface of a vibrating plate or putting a flexible sound absorbing material in a space at the back surface of the vibrating plate while the flexible sound absorbing material is brought into contact with the vibrating plate, thereby making these materials function as damping resistors, has been adopted as a method for damping high-band divisional vibration of a hard dome and vibration of a piston with which the vibrating plate moves integrally. However, this method has not been so effective to improve the frequency characteristic and the transient characteristic.

In order to solve the above problem, the present inventor has disclosed a speaker in which an acoustic resistor formed of a soft porous material is provided between a vibrating plate and a holder provided in proximity to and substantially in parallel to the vibrating plate or between an equalizer and a vibrating plate in the following patent document 1.

With respect to the speaker concerned, it has been possible to suppress degradation of the transient characteristic caused by lack of damping force of the speaker, particularly lack of electromagnetic force occurring at the outside of an in-use band of a speaker used in a network, and also acoustic damping force to the piston vibration with which the vibrating plate moves integrally is generated, thereby greatly improving the frequency characteristic and the transient characteristic.

However, in the speaker described above, the acoustic resistor formed of the soft porous material is provided between the vibrating plate and the holder or the equalizer, and thus the distance between the vibrating plate and the holder or the like must be made remarkably small in order to obtain effective damping force. Therefore, when the displacement of the vibrating plate increases, the soft porous material is pressed and increased in density, and thus the acoustic resistance value varies due to variation of the thickness of the soft porous material. Accordingly, there is a problem that distortion occurs in reproduced sound.

Therefore, the present inventor has disclosed a speaker in which the acoustic resistor is improved to have a multilayered structure made of a soft porous material and a hard porous material in the following patent document 2.

With respect to the acoustic resistor having the multilayered structure as described above, even when the soft porous material is compressed and thus increased in density in the case of large displacement of the vibrating plate, air flows through the hard porous material, so that substantially fixed acoustic resistance force is obtained at all times irrespective of magnitude of the displacement of the vibrating plate, the porous materials well follow vibration of the vibrating plate and thus the frequency characteristic and the transient characteristic are improved.

Afterwards, the present inventor has repetitively made studies on the improved speaker described in the patent document 2, and as a result he/she has found that distortion occurs in reproduced sound during operation and it has an adverse effect on the frequency characteristic, etc.

That is, in the speaker described in the patent document 2, the soft porous material and the hard porous material are stacked in the layered form, and thus air flows excellently through the hard porous material at the peripheral portion. However, air hardly flows at the center portion, and thus distortion is liable to occur in reproduced sound.

Patent Document 1: JP-B-03-059639

Patent Document 2: JP-A-01-320900

SUMMARY OF THE INVENTION

The present invention has been implemented to solve the foregoing problem, and has an object to reduce distortion of reproduced sound and improve a frequency characteristic and a transient characteristic when lack of electromagnetic damping force out of an in-use band is compensated by mechanical damping force of a filler to a vibrating plate.

With respect to a cone speaker, the above object can be attained by filling a first filler formed of a soft porous material having a low porosity at a peripheral portion and a second filler formed of a soft porous material having a higher porosity than that of the first filler at a center portion in a space between a back surface of a center cap secured to the center portion of the cone and an apical surface of a pole piece confronting the back surface of the center cap.

Furthermore, with respect to a dome speaker, the above object can be attained by filling a first filler formed of a soft porous material having a low porosity at a peripheral portion and a second filler formed of a soft porous material having a higher porosity than that of the first filler at a center portion in a space between a back surface of a dome type vibrating plate and an apical surface of a pole piece confronting the back surface of the dome type vibrating plate.

Still furthermore, with respect to a horn speaker having a convex vibrating plate projecting frontward, the above object can be attained by filling a first filler formed of a soft porous material having a low porosity at a peripheral portion and a second filler formed of a soft porous material having a higher porosity than that of the first filler at a center portion in a space between a back surface of a vibrating plate and an apical surface of a pole piece confronting the back surface of the vibrating plate.

Still furthermore, with respect to a horn speaker having a convex vibrating plate projecting backward, the above object can be attained by fixing a back cover behind a vibrating plate so that the back cover is spaced from the vibrating plate through a predetermined gap, and filling a first filler formed of a soft porous material having a low porosity at a peripheral portion and a second filler formed of a soft porous material having a higher porosity than that of the first filler at a center portion in a space between a back surface of the vibrating plate and an inner surface of the back cover.

It is recommended that the first filler and the second filler are configured so that the porosity thereof is high in the neighborhood of a center axis near to an opening portion intercommunicating with outside air and is reduced as the first and second fillers are farther away from the center axis.

Furthermore, it is normally recommended to fill the second filler in a cylindrical form so that the front end side thereof is accommodated in the first filler and the rear end side thereof is opened to the outside air at the back surface side of the speaker.

It is desired that at least one of the first filler and the second filler is formed of fabric or synthetic resin foamed material.

EFFECT OF THE INVENTION

In the present invention, as described above, the first filler formed of the soft porous material having a low porosity (that is, high resistance to air flow) is filled in the space between the back surface of the vibrating plate or the like and the apical surface of the pole piece so as to be brought into contact with both the back surface of the vibrating plate or the like and the apical surface of the pole piece, and the second filler formed of the soft porous material having a higher porosity (that is, low resistance to air flow) than the first filler is filled substantially along the center axis of the first filler in contact with the first filler, thereby preventing occurrence of distortion of reproduced sound which has been caused by deterioration of air flowability at the center portion of the first filler and density variation of the filler caused by vibration of the vibrating plate in the case of prior arts. Therefore, the frequency characteristic and the transient characteristic can be improved.

DESCRIPTION OF THE PREFERRED EMBODIMENTS

Figure 1:
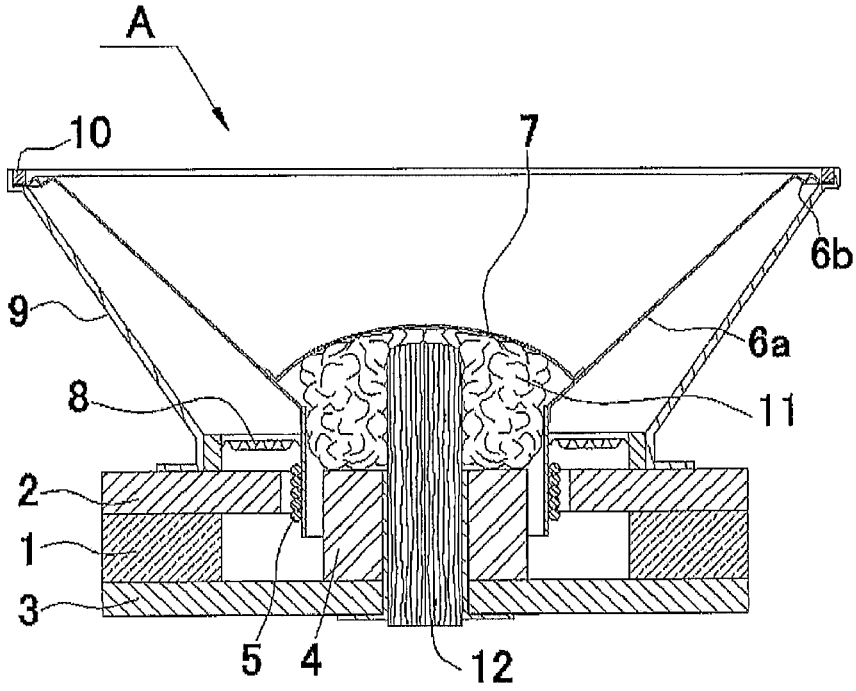
FIG. 1 is a cross-sectional view taken along a center axis of an embodiment of a cone speaker according to the present invention.

A best mode for carrying out the present invention will be described while referring to embodiments shown in the drawings.

Figure 2:
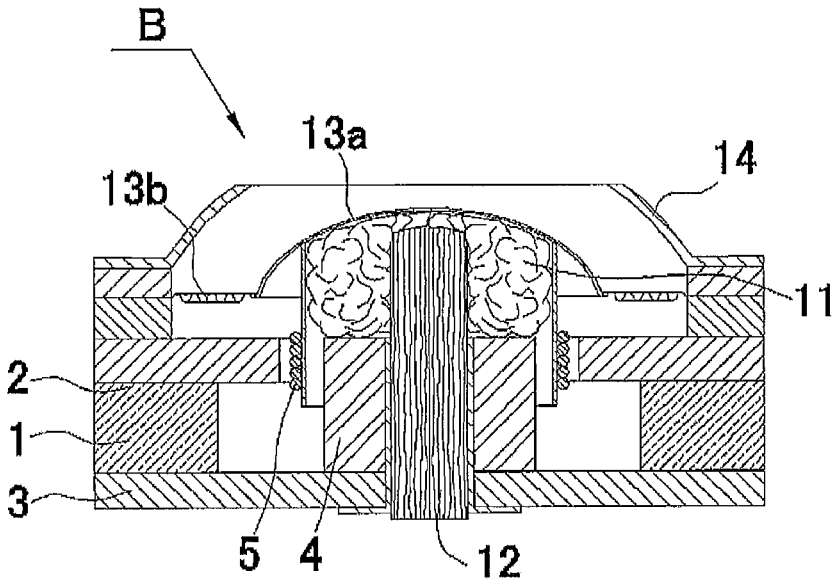
FIG. 2 is a cross-sectional view taken along a center axis of an embodiment of dome speaker according to the present invention.
Figure 3:
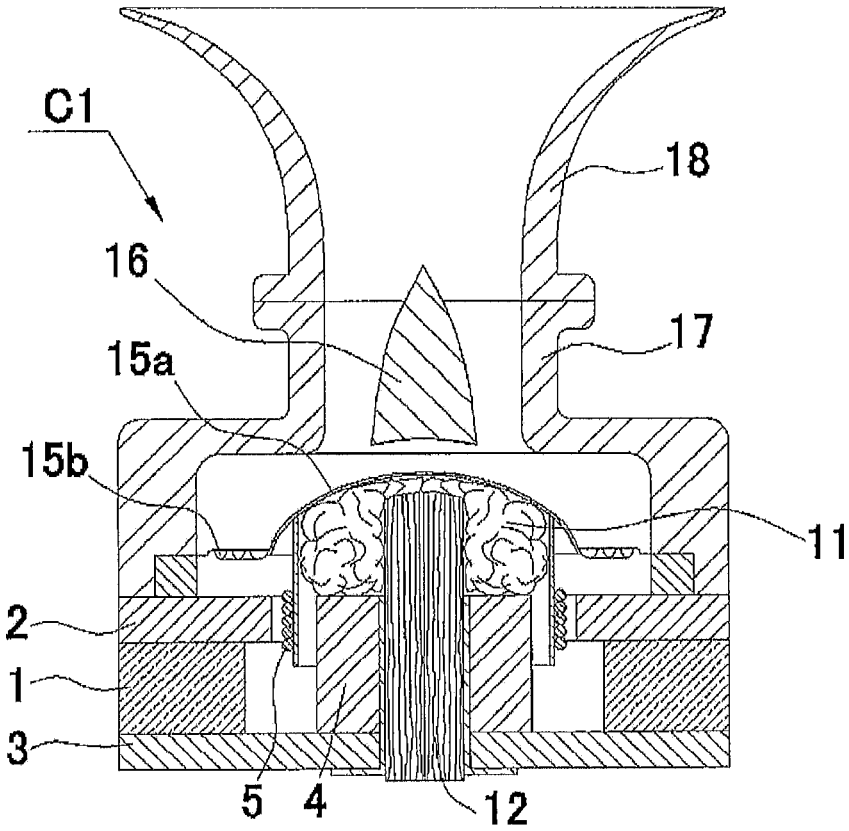
FIG. 3 is a cross-sectional view taken along a center axis of an embodiment of a horn speaker according to the present invention.
Figure 4:
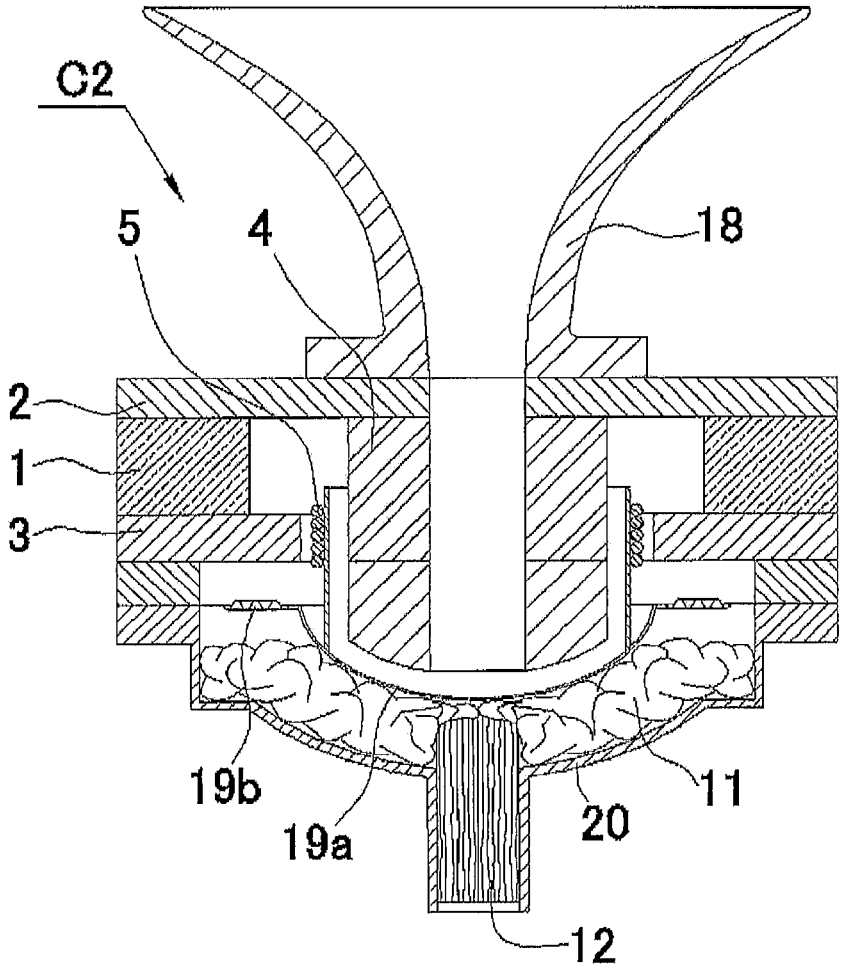
FIG. 4 is a cross-sectional view taken along a center axis of another embodiment of the horn speaker according to the present invention.

FIG. 1 is a cross-sectional view taken along the center axis of an embodiment of a cone speaker according to the present invention, FIG. 2 is a cross-sectional view taken along the center axis of an embodiment of a dome speaker according to the present invention, FIG. 3 is a cross-sectional view taken along the center axis of an embodiment of a horn speaker according to the present invention, and FIG. 4 is a cross-sectional view taken along the center axis of another embodiment of the horn speaker according to the present invention.

First, an embodiment shown in FIG. 1 will be described.

In FIG. 1, A represents a cone speaker according to the present invention, 1 represents a magnet, 2 represents a top plate, 3 represents a back plate and 4 represents a pole piece, and a magnetic circuit is constructed by these elements.

5 represents a voice coil, 6*a* represents a cone, and 6*b* represents an edge portion of the cone 6*a*. The voice coil 5 is disposed in the magnetic circuit within a space surrounding the pole piece 4 which is provided so as to be coaxial with a center hole of the doughnut-like top plate 2. By making audio current flow through the voice coil 5, the voice coil vibrates in conformity with the voice current and the movement of the voice coil is transmitted to the cone 6*a* having a truncated cone shape, thereby outputting sound.

7 represents a center cap secured to the center portion of the cone 6*a* having the truncated cone shape, 8 represents a damper, 9 represents a frame for fixing the edge portion 6*b* of the cone 6*a*, and 10 represents a gasket.

In the cone speaker A according to the present invention, a first filler 11 formed of a soft porous material having a low porosity (that is, a high resistance to air flow) is filled at a peripheral portion and a second filler 12 formed of a soft porous material having a higher porosity (that is, a low resistance to air flow) than the first filler is filled at a center portion in a space between a back surface of the center cap 7 and an apical surface of the pole piece 4.

That is, the first filler 11 formed of the soft porous material having the low porosity is filled in the space between the back surface of a dome type vibrating plate 13*a* and the apical surface of the pole piece 4, and the second filler 12 formed of the soft porous material having the higher porosity than the first filler is filled substantially along the center axis of the first filler in contact with the first filler.

The fillers which are different in porosity (different in resistance to air flow) are combined with each other as described above and filled so as to be brought into contact with the back surface of the center cap 7, thereby preventing degradation of flowability of air at the center portion of the first filler 11 and distortion of reproduced sound caused by density variation of the fillers due to vibration of the vibrating plate. Accordingly, the frequency characteristic and the transient characteristic can be improved.

That is, for example in a case where only the filler 11 is filled at the whole back side of the center cap 7, the density of the filled filler 11 varies (the resistance to the air flow varies) when the center cap 7 vibrates in conformity with vibration of the voice coil 5, so that damping force is affected and thus reproduced sound is distorted.

It is understood as described below that the foregoing construction can prevent distortion of reproduced sound. Comparing a case where the whole space of the back surface portion of the center cap 7 is filled with only the first filler 11 having large density (high resistance to air flow) and a case where no second filler 12 is filled to set this portion as an empty space in FIG. 1 and the first filler 11 is filled at only a place shown in FIG. 1, an air leaking path is limited to the area of the opening port in the former case, and the density variation caused by the vibration of the vibrating plate is great. In the latter case (when no second filler 12 is filled, this portion is set as an empty space and the first filler 11 is filled at only the place shown in FIG. 1), the opening surface spreads from the circular shape to the cylindrical side surface, so that the air leakage is excellent, the flow path is shortened and thus distortion is clearly reduced.

In order to reduce the distortion of the reproduced sound as described above, it is desired to reduce the resistance to the air flow inside the filler as the first filler 11 is farther away from the contact place between the first filler 11 and the center cap 7, and for this purpose, the filler to be filled is designed to be higher in porosity in the neighborhood of the center axis and reduced in porosity as it is farther away from the center axis.

In order to adjust the distribution of the resistance to the air flow in the filler as described above, it is recommended as shown in the figures that the second filler 12 having a high porosity is filled in a cylindrical shape, the front end side thereof is accommodated in the first filler 11 having a low porosity, and the rear end side thereof is provided so as to be opened to the outside air at the back surface side of the speaker.

It is recommended to use fabric or synthetic resin foamed material as a specific material of the filler.

Next, an embodiment shown in FIG. 2 will be described.

In FIG. 2, B represents a dome speaker according to the present invention. In FIG. 2, constituent elements represented by the same reference numerals as FIG. 1 represent the same constituent elements and thus the concrete descriptions thereof are omitted.

Furthermore, in FIG. 2, 13*a* represents the dome type vibrating plate (diaphragm), 13*b* represents an edge portion thereof and 14 represents an equalizer.

In this embodiment, in a space between the back surface of the dome type vibrating plate 13*a* and the apical surface of the pole piece 4, the first filler 11 formed of a soft porous material having a low porosity is filled at the peripheral portion and the second filler 12 formed of a soft porous material having a higher porosity than the first filler is filled at the center portion.

That is, the first filler 11 formed of the soft porous material having the low porosity is filled in the space between the back surface of the dome type vibrating plate 13*a* and the apical surface of the pole piece 4, and the second filler 12 formed of the soft porous material having the higher porosity than the first filler is filled substantially along the center axis of the first filler in contact with the first filler.

As in the case of the first embodiment of FIG. 1, it is desired that the second filler 12 is filled in a cylindrical shape, the front end side thereof is accommodated in the first filler 11 and the rear end side thereof is opened to the outside air at the back surface side of the speaker.

As described above, the fillers different in porosity are combined with each other as described above and filled so as to be brought into contact with the back surface of the vibrating plate 13*a*, thereby preventing occurrence of distortion in reproduced sound due to degradation of air flowability at the center portion of the first filler 11 as in the case of the first embodiment of FIG. 1, whereby the frequency characteristic and the transient characteristic can be improved.

Next, an embodiment shown in FIG. 3 will be described.

In FIG. 3, C1 represents a horn speaker according to the present invention. In FIG. 3, constituent elements represented by the same reference numerals as shown in FIG. 1 represent the same constituent elements, and further in FIG. 3, 15*a* represents a convex vibrating plate (diaphragm) projecting forward, 15*b* represents an edge portion thereof, 16 represents an equalizer, 17 represents a throat and 18 represents a horn.

In this embodiment, in a space between the back surface of the convex vibrating plate 15*a* projecting forward and the apical surface of the pole piece 4, the first filler 11 formed of a soft porous material having a low porosity is filled at the peripheral portion and the second filler 12 formed of a soft porous material having a higher porosity than the first filler is filled at the center portion.

That is, the first filler 11 formed of the soft porous material having the low porosity is filled in the space between the back surface of the convex vibrating plate 15*a* projecting forward and the apical surface of the pole piece 4, and the second filler 12 formed of the soft porous material having the higher porosity than the first filler is filled substantially along the center axis of the first filler in contact with the first filler.

It is desired that the second filler 12 is filled in a cylindrical shape, the front end side thereof is accommodated in the first filler 11 and the rear end side thereof is opened to the outside air at the back surface side of the speaker as in the case of the embodiment shown in FIG. 1.

By combining the fillers different in porosity as described above and filling these fillers so that the fillers are brought into contact with the back surface of the vibrating plate 15*a*, reproduced sound can be prevented from being distorted due to degradation of air flowability at the center portion of the first filler 11, whereby the frequency characteristic and the transient characteristic can be improved as in the case of the embodiment shown in FIG. 1.

Next, an embodiment shown in FIG. 4 will be described.

In FIG. 4, C2 represents a horn speaker according to the present invention. In FIG. 4, constituent elements represented by the same reference numerals as shown in FIGS. 1 and 3 represent the same constituent elements in FIGS. 1 and 3, and in FIG. 4 19*a* represents a convex vibrating plate projecting backward, and 20 represents a back cover.

In this embodiment, in a space between the back surface of the convex vibrating plate 19*a* projecting backward and the inner surface of the back cover 20, the first filler 11 formed of a soft porous material having a low porosity is filled at the peripheral portion of the space, and the second filler 12 formed of a soft porous material having a higher porosity than the first filler is filled at the center portion of the space.

That is, the first filler 11 formed of the soft porous material having the low porosity is filled in the space between the back surface of the convex vibrating plate 19*a* projecting backward and the inner surface of the back cover 20, and also the second filler 12 formed of the soft porous material having the higher porosity than the first filler is filled substantially along the center axis of the first filler in contact with the first filler.

As in the case of the embodiment shown in FIG. 1, it is desired that the second filler 12 is filled in a cylindrical shape, the front end side thereof is accommodated in the first filler 11 and the rear end side thereof is opened to the outside air at the back surface side of the speaker.

As described above, by combining the fillers different in porosity as described above and filling these fillers so that the fillers are brought into contact with the rear side surface of the vibrating plate 19*a*, reproduced sound can be prevented from being distorted due to degradation of air flowability at the center portion of the first filler 11, whereby the frequency characteristic and the transient characteristic can be improved as in the case of the embodiment shown in FIG. 1.

The present invention is not limited to the above embodiments, and it contains all embodiments which would be easily recognized by persons skilled in the art from the foregoing description within the scope of the object.

INDUSTRIAL APPLICABILITY

As described above, according to the present invention, reproduced sound can be prevented from being distorted due to degradation of air flowability at the center portion of the filler, whereby the frequency characteristic and the transient characteristic of the speakers according to the respective embodiments can be improved, so that the present invention has great industrial utility value.

The invention claimed is:

1. A dome speaker comprising:

a vibrating plate that has a convex dome shape;

a pole piece that confronts the vibrating plate;

a magnetic circuit including the pole piece formed in an area surrounding the pole piece; and a voice coil placed in the magnetic circuit; wherein a motion of the voice coil that is driven by making audio current flow through the voice coil causes the output of sound, a first filler made of a soft porous material having a low porosity is filled at a peripheral portion of a space formed between a back surface of the vibrating plate and an apical surface of the pole piece, and a second filler made of a soft porous material having a higher porosity than the first filler is filled substantially along a center axis of the first filler and in contact with the first filler.

2. The speaker according claim 1, wherein both the first filler and the second filler are configured to be high in porosity in the neighborhood of the center axis and reduced in porosity as the first and second fillers are farther away from the center axis.

3. The speaker according to claim 1, wherein the second filler is filled in a cylindrical shape, and a front end side thereof is accommodated in the first filler while a rear end side thereof is disposed so as to be opened to outside air at the back surface side of the speaker.

4. The speaker according to claim 1, wherein at least one of the first filler and the second filler is formed of fabric.

5. The speaker according to claim 1, wherein at least one of the first filler and the second filler is formed of synthetic resin foamed material.

* * * * *